United States Patent [19]

Weihe

[11] 4,346,807

[45] Aug. 31, 1982

[54] FLATWARE PROCESSING SYSTEM

[76] Inventor: Clyde R. Weihe, 17 Linbergh Ave., Needham Heights, Mass. 02194

[21] Appl. No.: 146,206

[22] Filed: May 5, 1980

[51] Int. Cl.[3] ..... A47F 7/00

[52] U.S. Cl. ..... 211/60 R; 211/126; 220/23.8

[58] Field of Search ..... 211/126, 127, 41, 60 R; 206/557, 558; 220/23.2, 23.8

[56] References Cited

U.S. PATENT DOCUMENTS 2,344,937 3/1944 Brazier ..... 206/558 X 2,875,916 3/1959 Schroeder ..... 211/41 X 3,383,148 5/1968 Dicken ..... 211/41 X

*Primary Examiner*—Roy D. Frazier

*Assistant Examiner*—Robert W. Gibson, Jr.

*Attorney, Agent, or Firm*—Herbert L. Gatewood

[57] ABSTRACT

A flatware processing system is provided for commercial food service wherein a pre-soaking unit for the flatware is provided in combination with a dishwashing machine and the flatware is pre-soaked with hot detergent water prior to being introduced into the dishwashing machine. Additionally, a flatware basket is provided for use in the dishwashing machine which allows better washing and rinsing of the flatware.

2 Claims, 6 Drawing Figures

FLATWARE PROCESSING SYSTEM

BACKGROUND OF THE INVENTION

1. Field of the Invention

This invention relates to, in general, a flatware processing system in commercial food service for pre-soaking and washing of flatware. More specifically, the invention concerns a pre-soaking unit suitable for use in combination with a dishwashing machine, and a basket of particular construction for the holding of flatware in the dishwashing machine during washing and rinsing.

2. Description of the Prior Art

It is common practice for those who eat out in commercial food service operations, e.g., restaurants, cafes, diners, at banquets, dinner meetings, etc. to encounter soiled flatware, i.e., knives, forks, and spoons. While the diner's complaint may result in embarrassment to the eating establishment, the soiled flatware also indicates an unsanitary situation.

Although there are a number of reasons for soiled flatware, including lack of proper attention by bus-boys, dishwashers, etc., the primary reasons involve the manner in which flatware is now pre-soaked, if at all, and then loaded into the dishwashing machine.

In general, pre-soaking of flatware, where this practice is followed at all, prior to loading the flatware into a dishwashing machine, merely involves tossing soiled flatware into a flat pan or the like containing water. As a result, the pieces of flatware lay flat in the pan, one piece on top of another, and crowded together. The pre-soak water soon becomes cold, even when hot water has been used, and laden with food soil. Pre-soaking under these conditions has only marginal value, and adds little, if anything, to the cleaning effort.

After pre-soaking, the flatware is removed from the soak water and is loaded into baskets for placement in the dishwashing machine, wherein the flatware is subjected to a wash and rinse cycle. Dishes, cups and glasses placed in the dishwashing machine are racked in such a manner as to receive the full benefit of the wash and rinse cycle; however, the flatware, because of the manner of loading, and the construction of the flatware baskets now used, have little chance to receive the same manner of good cleaning action.

It is usual practice for a bus-boy or dishwasher to put as many pieces of flatware as possible in the flatware basket, prior to placing the basket in the dishwashing machine. As a result, the flatware is closely packed together, spoons often nesting in other spoons and many areas of the pieces of flatware are not exposed to the cleaning force of the washing and rinse water. Close spacing of flatware is particularly a problem in the case of forks, as the design of the fork presents a unique problem in cleaning. Food soil often wedges between the tines of a fork, and is very difficult to remove.

Commercial dishwashing machines have both a wash and rinse cycle, and a good rinse is essential to remove the detergent wash water from the flatware. However, as it is usual, because of the design of the present flatware baskets, and the overloading by bus-boys or dishwashers, that the flatware is inadequately rinsed, unsightly detergent spots result on the flatware, on drying.

As the result of these unsightly spots, it is usual practice for wetting agents to be used in the dishwashing machine; however, for these agents to provide maximum benefit to the appearance of the flatware, the flatware must not only be in an upright position, but each piece must be individually and entirely exposed. Where flatware is crowded together, and spoons are nested in one another, the benefit of the wetting agents is naturally somewhat limited.

A further problem caused by the design flatware baskets presently used in washing flatware results from the fact that the basket compartments are too deep. Thus, when the flatware is placed in the receptacles of the basket, only the ends of the flatware are exposed, and the flatware can only be removed by taking a hold of the exposed ends. If the flatware has been placed handle-down in the receptacle, the eating or business end of the flatware must then necessarily be grasped by hand to remove the flatware from the basket. Thus, this presents an unsatisfactory condition, as the flatware which has just been washed is now contaminated by touching. That this actually occurs is often seen on knife blades and spoons by the unsightly finger marks that result.

SUMMARY OF THE INVENTION

In accordance with the basic aspects of my invention, there is provided a flatware processing system for use in commercial food service for washing flatware which comprises in combination with a dishwashing machine a means for holding flatware for pre-soaking, prior to introduction of the flatware in the dishwashing machine, in which pre-soaking means the flatware is subjected to a continuous flow of hot detergent water, to loosen and at least partially remove food soil from the flatware.

In the more particular aspects of my invention, there is provided a means for pre-soaking flatware with a continuous flow of hot detergent water which means comprises a reservoir for containment of a flow of hot detergent water and for holding and supporting the flatware in said water while being pre-soaked; and means for supporting the reservoir in first and second vertical positions.

In the first vertical position, the pre-soaking means supports the flatware, the eating ends thereof being disposed in the reservoir of water, at an obtuse angle with respect to the horizontal, i.e., a table on which the pre-soaking unit is located. When raised to the second vertical position, prior to transfer of the pre-soaked flatware to the dishwashing machine, hot detergent soiled water and food soil is discharged from the pre-soaking unit. Thus, removal of the flatware from the pre-soaking unit is facilitated, and without the necessity for placing one's hand in hot water.

In a still further aspect of my invention, there is provided a basket means for holding flatware while being washed and rinsed in a dishwashing machine comprising a horizontally disposed planar base member; and a plurality of individual, spaced-apart receptacles supported on said base member each having the shape of a right, truncated cone for containment of a limited number of pieces of flatware, each said receptacle being open at the top and defined by a horizontally disposed circular shaped opening of pre-determined diameter in a plane parallel to the said planar base member, said circular-shaped opening limiting the number of pieces of flatware that can be placed in each said receptacle and the truncated shape of each said receptacle allowing the flatware placed in the receptacle to spread, or fan out at the bottom of the receptacle thereby allowing the ends of the flatware protruding out of the receptacle to also spread or fan out, and exposing the surfaces of the flatware for washing and rinsing, said base member and said receptacles being of porous construction thereby allowing the free passage of wash and rinse water into and from the inside of the receptacles.

BRIEF DESCRIPTION OF THE DRAWING

The invention is described in greater detail hereinafter, reference being made to the drawing, to facilitate understanding of the invention, in which.

DETAILED DESCRIPTION OF THE INVENTION AND THE PREFERRED EMBODIMENTS

Figure 1:
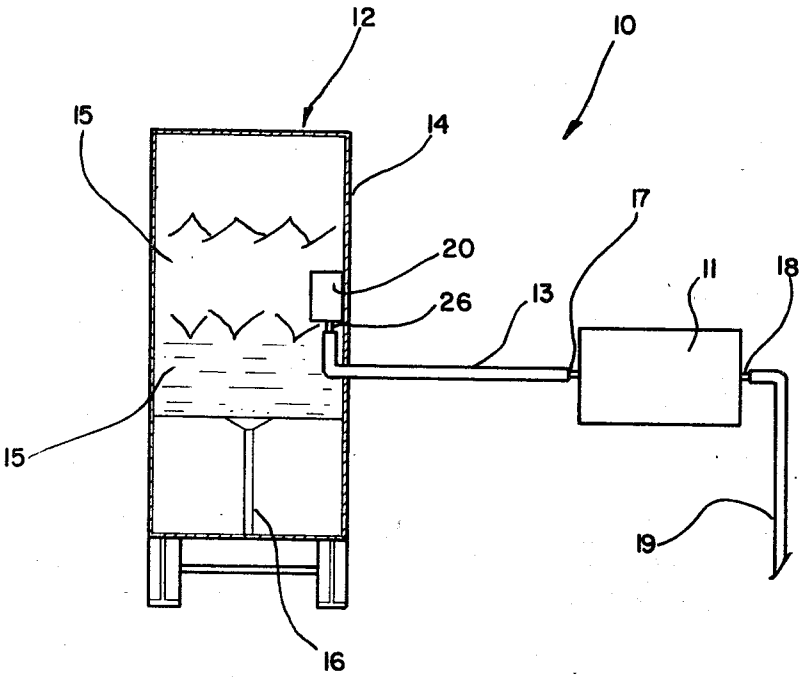
FIG. 1 is a schematic view showing a flatware processing system in accordance with the invention.

Turning now to the drawing, there is shown in FIG. 1 thereof in schematic illustration, a flatware processing system 10 in accordance with the basic aspects of the invention, for use in commercial food service operations. As shown in the drawing, flatware processing system 10 comprises in combination a pre-soaking means 11 for flatware, i.e., knives, forks and spoons, with a dishwashing machine 12, the two being connected together by means of conduit 13, e.g., suitable sized copper tubing, or flexible rubber tubing.

Figure 2:
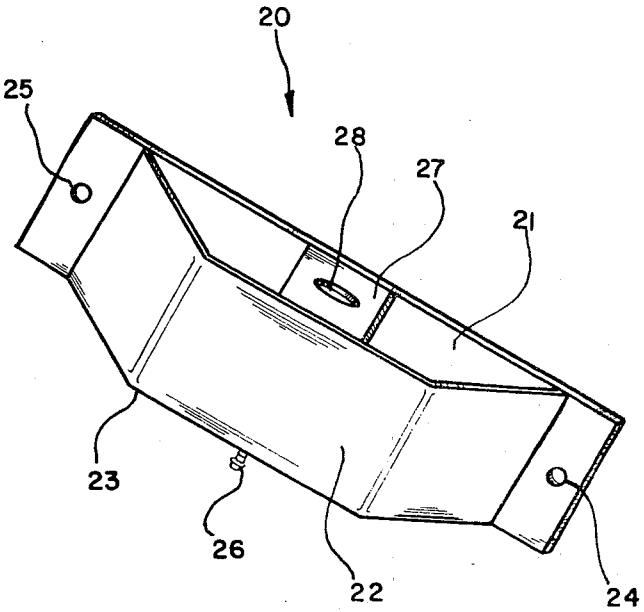
FIG. 2 is a perspective view of a reservoir in accordance with the invention for hot detergent water supplied to the pre-soaking means of the invention, this reservoir being located in the dishwashing machine shown in FIG. 1.

For sake of clarity, as it forms no part of the specific invention herein, dishwashing machine 12 is shown in FIG. 1 only schematically. However, it will be appreciated that dishwashing machine 12 can be of any of the conventional designs now used in commercial food service operations. Nevertheless, these conventional dishwashing machines, in the preferred embodiment of the invention disclosed herein, are modified for use in a dishwashing system according to the invention by having located therein, on a convenient wall surface 14 or the like, a hot detergent water reservoir 20, the construction of which is shown more clearly in FIG. 2 of the drawing. Thus, a continuous supply, as needed, of hot detergent water can be furnished from dishwashing machine 12 to pre-soaking means 11.

Hot detergent water reservoir (or collecting unit) 20, as shown, comprises a planar, rectangular shaped back member 21, a front member 22, and a base member 23 connected to the front member 22 and back member 21, thereby providing an open-top reservoir for catching and containment of a supply of hot detergent water for pre-soaking means 11. As will be appreciated, the hot detergent water in the dishwashing machine, during its operation, is thrown about in all directions, as indicated generally by reference numeral 15, a part of the water being collected in reservoir 20, and the remainder being discharged in usual fashion to waste through outlet drain 16.

Hot detergent water reservoir 20, as previously indicated, is located on one of the walls within dishwashing machine 12, in such a location as to easily collect a supply of the hot detergent water being splashed about during operation of the dishwashing machine, in its washing cycle. This is accomplished by suitable fasteners, e.g., threaded fasteners, located in openings 24, 25 of reservoir 20 and which connect back member 21 to the inside surface of wall 14. Reservoir 20 can obviously be located at various places on the wall of dishwashing machine 12 provided its location collects a suitable supply of hot detergent water, as needed, and provides adequate gravity flow of that water through conduit 13 to pre-soaking unit 11. As indicated in the drawing, reservoir 20 is provided in its bottom 23 with an outlet 26, to which is connected one end of conduit 13, the other end being connected to inlet 17 of pre-soaking means 11. On the outlet side of pre-soaking means 11, and on the same level, is provided outlet connection 18, to which is connected conduit 19 for discharging soiled hot detergent water from pre-soaking means 11 to waste. Although not shown in the drawing, either of the conduit means can, if desired, be provided with valves for isolation of the pre-soaking means from dishwashing machine 12.

Optionally, as shown in the drawing, reservoir 20 can be provided with a rectangular shaped support means 27 in which is provided threaded circular shaped opening 28, for mounting of a pump, if desired.

Reservoir 20 can obviously be of various materials of construction, e.g., rubber or plastic coated metal, or of various plastic materials conventionally used in dishwashing machines. The only requirement is that whatever rubber or plastic materials are used, they must be able to withstand the operating conditions and temperature of the dishwashing machine. Preferably, reservoir 20 is of plastic, as this facilitates and simplifies its manner of manufacture. Back member 21, front member 22, and base member 23, in this case, are separately manufactured by suitable molding techniques, or the back and base can be die-cut out of sheets of plastic material, and then adhesively bonded together. However, it will be appreciated that, if desired, the entire reservoir unit can be manufactured by a single injection molding operation. Although front member 23 of reservoir 20 is shown to be of bowed-out rectangular sections, it obviously can be of a different design, for example, of arcuate shape. This may depend somewhat on the particular design of the dishwashing machine in which the reservoir is located, as will the size of the reservoir.

Figure 3:
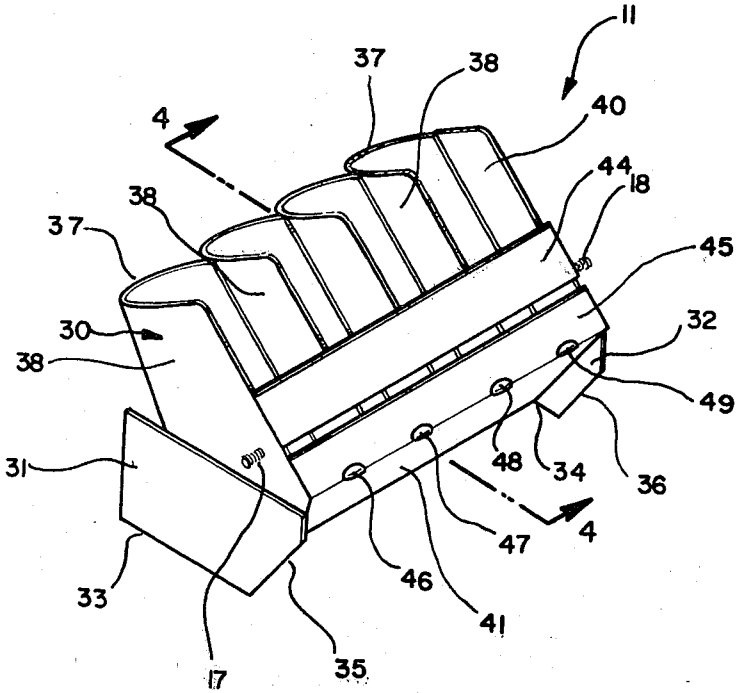
FIG. 3 is a view in perspective of a pre-soaking means according to the invention.

Referring now more specifically to FIG. 3 of the drawing, there is shown pre-soaking means 11 for pre-soaking flatware in accordance with the invention comprising a reservoir 30 for containment of a flow of hot detergent water and for holding and supporting the flatware in said water while being pre-soaked. Attached to reservoir 30 at opposed sides thereof are vertically disposed planar support means 31 and 32 for supporting the reservoir in first and second vertical positions, the reasons for which will be later explained. To accomplish this, support means 31 and 32 are each provided with flat, horizontally disposed edges 33, 34 for supporting reservoir 30 during the pre-soak cycle on a conventional work table, bench, or the like, and edges 35, 36 for supporting reservoir 30 in an upright position.

It will be appreciated, however, that other means can be adopted for placing reservoir 30 in the two different vertical positions. For example, reservoir 30 can be hingedly mounted on support members that permit the reservoir to be positioned in two different vertical positions, as desired. Or the reservoir can be a separate and distinct unit from the support means, the support means being of a cradle-like construction which permits the support of the reservoir in the desired two different vertical positions.

Reservoir 30, as shown by the drawing, is divided into a plurality of separate and distinct compartments connected together, each compartment providing a reservoir in and of itself for containment of hot detergent water, and for the holding and support of flatware during the pre-soaking operation. Although four compartments are shown in the pre-soaking means of the invention shown in the drawing, it will be appreciated that a greater or lesser number of compartments can be provided as desired. It is most desirable, however, that the reservoir be divided into separate and distinct compartments, as this will facilitate handling of the flatware as well as somewhat limit the loading of the flatware in the pre-soaking unit.

Each compartment of the pre-soaking means 11, as shown in the drawing, is made up of a base member 37 which, as shown, is of an arcuate cross-section providing an elongated concavity, open at the top end, for supporting the flatware in a lengthwise manner, and an integral side member 38. The reservoir compartments intermediate those at the ends of reservoir 30 share side members 38, as shown, as a common side member in which are provided a plurality of openings 39 for the passage of hot detergent water from one compartment serially to the other, and finally to waste. The arcuate-shaped base member 37 of the compartment at the right end of reservoir 30 is attached, as shown, by suitable means, e.g., adhesive, to end wall 40, thereby providing a closed end compartment.

The bottom ends of the elongated concavities are closed off by end member 41, thereby providing closed individual compartments for the containment of the hot detergent water and flatware. As will be appreciated by reference to FIG. 4 of the drawing, the same water level will be maintained in each compartment in the pre-soaking means 11. This water level will depend somewhat on the particular obtuse angle that reservoir 30 makes with the horizontal and while this angle is not necessarily critical it should provide complete submergence of the flatware being pre-soaked.

Figure 4:
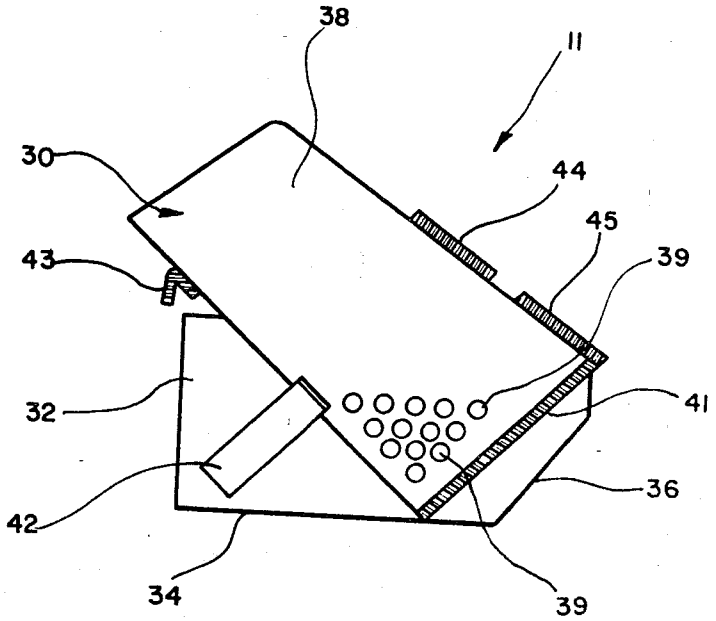
FIG. 4 is a view in cross-section of the pre-soaking means shown in FIG. 3, taken at secant lines 4—4.

Reservoir 30, as seen by reference to FIG. 4 of the drawing, is attached to, and supported in its desired first vertically disposed position, by a support arm 42, one end of which is attached to support means 34 and the other end of which is attached to the reverse side of a suitable reservoir compartment. Support arm 42 is a rectangular shaped member of suitable length to reach the distance desired and to provide proper support to the reservoir. It will be appreciated that a singular support arm (not shown) is located at the other end of the pre-soaking means, thus providing support of reservoir at both ends.

To provide ease in carrying pre-soaking means 11, as in the preferred embodiment of the invention it is entirely portable, handle means 43, as shown in FIG. 4, is provided, attached to the underside of the reservoir by suitable means, depending on the particular material of construction of the unit. Handle means 43 is of an elongated V-shaped construction, and should be of sufficient length to bridge at least two compartments, to provide a proper base for fastening.

While in the drawing, the base members 37 of pre-soaking means 11 are seen to be elongated concavities, it will be appreciated that such members can be flat bottomed, if desired. However, the arcuate shape facilitates removal of the flatware from, as well as its loading in, the pre-soaking unit, and is most preferred. In somewhat slightly different construction, each compartment can be of elongated U-shaped configuration, the intermediate members being joined together at their respective adjacent sides by suitable means such as fasteners or adhesives, e.g., epoxy adhesive. In this case, the two joined together sides of the U-shaped compartment will form a common wall between the two compartments. As before, a plurality of openings will be provided in the common wall to allow for passage of hot detergent water from one compartment to the next. In the U-shaped construction, the side walls provided can be of the same height from one end to the other, or the walls can taper from one end to the other, as shown in FIG. 4 of the drawing. Where the walls are tapered from one end to the other as in FIG. 4, it will be appreciated that this will result in some savings of material in the manufacture of the reservoir unit.

Pre-soaking means 11 can be manufactured of various materials, e.g., various metals such as stainless steel, plastic coated metal base, and of various plastics, e.g., vinylchloride. However, any plastic singular can be used which can withstand hot detergent water. Preferably pre-soaking means 11 is constructed of plastic materials, as this simplifies it construction and at considerably less costs. Moreover, with such a material, a pre-soaking unit of integral construction can be manufactured by conventional molding techniques.

Figure 5:
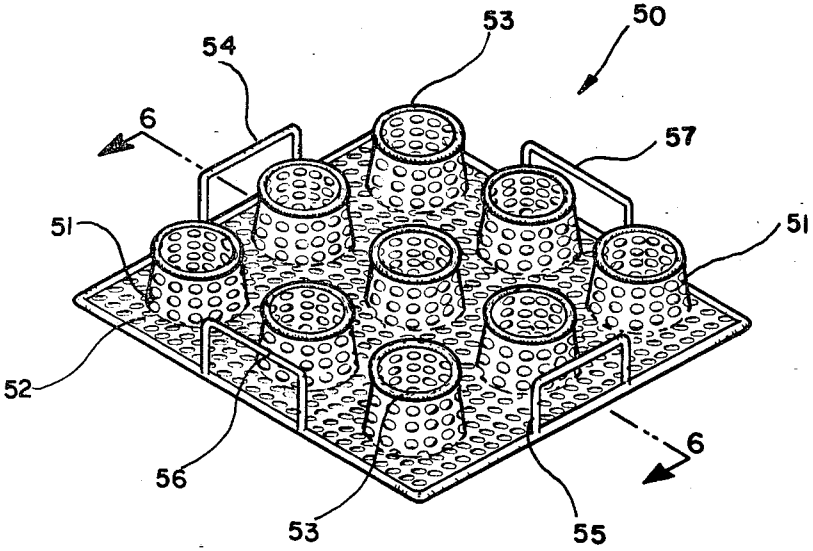
FIG. 5 is a perspective view of a basket for flatware in accordance with the invention for placement in a dishwashing machine.

In a still further aspect of the invention, there is provided a basket 50 for holding flatware while being washed and rinsed in dishwashing machine 12 which comprises a plurality of open-top, spaced-apart individual receptacles 51 located on a horizontally disposed, planar base member 52 of square configuration. As shown in the drawing, reference being made to FIGS. 5 and 6, receptacles 51 are in the shape of a truncated cone, the open-top being defined by circular-shaped opening 53 of predetermined diameter disposed in a plane parallel to base member 52. In directly opposed relationship, and attached to base member 52 at its perimeter, are provided handles 54, 55 and 56, 57, which facilitate carrying of flatware basket 50.

Figure 6:
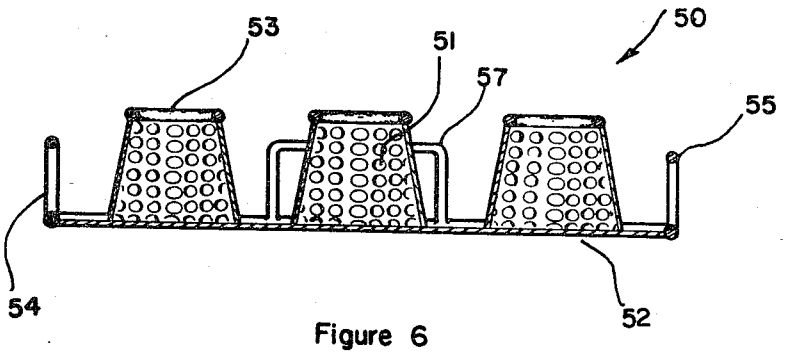
FIG. 6 is a cross-sectional view of the flatware basket shown in FIG. 5, taken at secant lines 6—6.

As shown in the drawing, the receptacle 51 and base member 52 are of a porous construction to allow for complete and unimpeded flow of water around the basket and into and out of the receptacles. It will be appreciated, however, that this porous or open construction can take various configurations other than that shown in the drawing, provided the water flow is such as to obtain the desired cleaning action. Moreover, the basket can take other shapes, e.g., base member 52 can be other than of square configuration, e.g., circular or rectangular shape, if desired. Of criticality in this aspect of the invention, however, is the truncated shape of receptacle 51, the reason for which will be later made clear. In certain instances, however, the base of the truncated cone can be either concave or convex, rather than flat as shown in FIG. 6 of the drawing. Or the bottom can be flat on the outer perimeter with a convex central portion. Such a construction may facilitate the spreading out of the flatware placed in the receptacle, as more fully disclosed hereinafter.

Basket 50 can be of various materials of construction, as desired. In the practice of the invention, the receptacles and base member can be separately formed of suitable metal of open or reticulated construction and these then join together, followed by dip coating or the like of the metal construction with suitable plastic materials. Or the basket can be formed entirely of plastic materials conventionally used for flatware basket manufacture. In this case, the basket can be formed of unitary construction in accordance with conventional molding techniques, e.g., injection molding.

Whatever the manner of manufacture, receptacles 51 must not only be of a right truncated conical configuration, as shown in the drawing, they must also not be so high as to prevent grasping of the flatware by their handles on removing the flatware from the receptacles after washing and rinsing in the dishwashing machine. While the height of the truncated cone receptacle will depend somewhat on the diameter of circular shaped opening 53, in general, the plane of the circular shaped opening 53 should be spaced no more than about 2¾ inches from the plane of base member 52. In this case, and to limit the amount of flatware that can be placed in each individual receptacle, to afford optimum spreading of the handles of the flatware in placement in the receptacle, as hereinafter more fully describe, the open top will be only about 2¾ inches in diameter. The base diameter of such a truncated cone will desirably have a diameter of about 3½ inches. Nevertheless, it will be appreciated that such dimensions can be varied somewhat provided the desired effect is realized. The main consideration is that the receptacle not be of uniform diameter from top to bottom, thus limiting the number of pieces of flatware that can be placed in the receptacle yet not confining the flatware to the same degree. While the preferred receptacles are of conical shape, it will be appreciated that the same result can be obtained with a receptacle of polygonal configuration in cross-section, so long as the truncated construction is maintained.

In use of the flatware processing system of the invention, pre-soaking means 11 is connected to the dishwashing machine 12, and is positioned on a table or workbench so as to be in its first vertical position, i.e., support means 31, 32 rests on horizontally disposed edges 33, 34. Thus, when the dishwashing machine is turned on, during its dishwashing cycle, hot detergent water is supplied to the pre-soaking means and the reservoir thereof is filled to its working level and is maintained at that level with a continuous supply of hot detergent water. Overflow is carried from the pre-soaking means to waste by conduit 19.

Flatware is then placed, business or eating end down, in the compartments of the pre-soaking means and are left therein, as desired, from several minutes to a half hour or more. Prior to removal of the flatware from the pre-soak water, the pre-soaking means 11 is raised vertically so as to be in its second vertical position, i.e., to rest on front edges 35, 36 of support means 31, 32. In this position, the pre-soaking means is raised so that the elongated concavities are essentially in vertically disposed position. Thus, except for spaced-apart members 44, 45, the flatware would fall out of the pre-soaking means compartments.

On raising of the pre-soaking means to the second vertical position, soiled hot detergent water and food soil are discharged from the bottom front of the pre-soaking means between the spaced-apart top members 44, 45, and through the plurality of openings 46, 47, 48 and 49, optionally and preferably provided at the juncture between top member 45 and end member 41. It will be appreciated that these openings can be of various shape and size, as desired, to allow for discharge of the hot detergent water and food soil. More or less than four openings can be provided; however, in general one opening should be provided for each compartment of the reservoir. Also, as will be appreciated, top members 44, 45 need not be two members. In certain instances, it may be desirable, or even more preferable, to have a single top member, e.g., only member 44. Also, the top member can more or less provide a complete top closure for the compartments, leaving only the top ends of the elongated cavities opened for insertion of the flatware.

Discharge of the soiled hot detergent water from the pre-soaking means 11, prior to removal of the flatware, as will be appreciated, is much desired, to preclude a dishwasher or other worker having to place his hands in the hot detergent water. Thus, a more safe and enjoyable working situation is provided, as the dishwasher runs no risk of having to place his hands in water that is too hot to accomplish the task at hand.

On removal of the flatware from the pre-soaking means 11, the flatware is placed in the receptacles 51 of the flatware basket 50 in anticipation of placement in the dishwashing machine for washing and rinsing of the flatware in conventional manner along with the plates, cups, saucers, etc. Critically, however, because of the particular construction of the receptacles, the flatware is better exposed to the dishwashing machine action and better cleaning results. This, in turn, results not only in a more sanitary food service operation but more satisfied diners.

On placement of the flatware in the receptacles of the flatware basket, handle down, because of the truncated cone shape and the limiting top opening, the handles spread out to occupy the entire base of the cone, i.e., the handles tend to pivot outwardly toward the outer perimeter of the base. As a result, the business or eating ends of the flatware also spread out from one another, leaving not only the handles but, in particular, the eating ends of the flatware better exposed for contact by the hot detergent water during the washing cycle and the rinse water during the rinse cycle. The top opening, as will be appreciated, necessarily limits the number of pieces of flatware which can be placed in the receptacle. However, as the confining perimeter of the receptacle is gradually enlarged from top to bottom, and a substantial length of the flatware extends outside of the receptacle, the flatware ends are not at all as restricted and are allowed to spread out from one another.

When the flatware basket is removed from the dishwashing machine, the flatware is easily removed by the handles, as a portion of the handles of the flatware extend beyond the top opening of the receptacle. Thus, it is unnecessary to take a hold of the eating end of the flatware, to remove it from the flatware basket, providing a much more sanitary flatware processing.

As many different embodiments of this invention will now occur to those skilled in the art, it is to be understood that the specific embodiments of the invention as presented herein are intended by way of illustration only and are not limiting on the invention, but that the limitations thereon can be determined only from the appended claims.

I claim:

1. Basket means for holding flatware while being washed and rinsed in a dishwashing machine comprising:

(a) a horizontally disposed base member; and (b) a plurality of individual, spaced-apart receptacles supported on said base member, each receptacle having the shape of a right, truncated cone for containment of a limited number of pieces of flatware, each receptacle being opened at the top and defined by a horizontally disposed circular-shaped opening of pre-determined diameter in a plane parallel to the said base member, said circular-shaped top opening limiting the number of pieces of flatware that can be placed in each said receptacle and the truncated shape of said receptacle allowing the flatware placed in the receptacle to spread out at the bottom of the receptacle, exposing the flatware surfaces to washing and rinsing water, said base member and said receptacles being of porous construction thereby allowing the free passage of wash and rinse water into and from the inside of the flatware receptacles.

2. Basket means for holding flatware while being washed and rinsed in a dishwashing machine according to claim 1 wherein handles are provided on said base member to facilitate carrying of the basket.

* * * * *